US006812953B2

(12) United States Patent
Peterson et al.

(10) Patent No.: US 6,812,953 B2
(45) Date of Patent: Nov. 2, 2004

(54) SYSTEM FOR REDUCING THE EFFECT OF AERODYNAMIC INDUCED ERRORS IN A DROP-ON-DEMAND PRINTING SYSTEM

(75) Inventors: Kenneth W. Peterson, Camas, WA (US); David M. Wetchler, Vancouver, WA (US); George C. Ross, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 85 days.

(21) Appl. No.: 10/056,292

(22) Filed: Jan. 24, 2002

(65) Prior Publication Data

US 2003/0137575 A1 Jul. 24, 2003

(51) Int. Cl.[7] ..... B41J 29/38; B41J 2/51
(52) U.S. Cl. ..... 348/12; 347/43
(58) Field of Search ..... 347/12, 43, 85, 347/86

(56) References Cited

U.S. PATENT DOCUMENTS 4,672,432 A * 6/1987 Sakarada et al. ..... 358/75
6,196,663 B1 3/2001 Wetchler et al. ..... 347/43
6,257,693 B1 7/2001 Miller et al. ..... 347/19
6,270,201 B1 8/2001 Kasperchik et al. ..... 347/65
6,273,550 B1 * 8/2001 Brown ..... 347/43
6,334,665 B1 * 1/2002 Yoshida ..... 347/40
6,729,713 B2 * 5/2004 Shirakawa ..... 347/43

FOREIGN PATENT DOCUMENTS

EP 0 610 096 8/1994
EP 0 892 265 1/1999

* cited by examiner

*Primary Examiner*—Stephen D. Meier
*Assistant Examiner*—Alfred Dudding

(57) ABSTRACT

A multiple ink jet printing system comprising a plurality of rows of dark dye nozzles and light dye nozzles. Each row of dark dye nozzles is coupled to a supply of dark dye ink, and each row of light dye nozzles is coupled to a supply of light dye ink. Each of the rows of dark dye nozzles and light dye nozzles are arranged substantially parallel to each other, and at least one row of dark dye nozzles is separated from the next row of dark dye nozzles by at least one row of light dye nozzles.

35 Claims, 4 Drawing Sheets

SYSTEM FOR REDUCING THE EFFECT OF AERODYNAMIC INDUCED ERRORS IN A DROP-ON-DEMAND PRINTING SYSTEM

FIELD OF THE INVENTION

The present invention relates generally to ink jet printing systems. More particularly, the present invention relates to a drop-on-demand printing system that reduces the effect of aerodynamic induced errors during printing.

BACKGROUND OF THE INVENTION

An ink jet printer produces a printed image by printing a pattern of individual dots (or pixels) at specific defined locations of an array. These dot locations, which are conveniently visualized as being small dots in a rectilinear array, are defined by the pattern being printed. The printing operation, therefore, can be pictured as the filling of a pattern of dot locations with dots of ink. Ink jet printers are described in detail in U.S. Pat. No. 6,270,201, incorporated herein by reference.

Ink jet printers print dots by ejecting a small volume of ink onto the print medium. These small ink drops are positioned on the print medium by a moving carriage that supports a printhead cartridge containing ink-drop generators. The carriage traverses over the print medium surface and positions the printhead cartridge depending on the pattern being printed. An ink supply, such as an ink reservoir, supplies ink to the drop generators. The drop generators are controlled by a microprocessor or other controller and eject ink drops at appropriate times upon command by the microprocessor. The timing of ink drop ejections typically corresponds to the pixel pattern of the image being printed.

In general, the drop generators eject ink drops through a nozzle or an orifice by rapidly heating a small volume of ink located within a vaporization or firing chamber. The vaporization of the ink drops typically is accomplished using an electric heater, such as a small thin-film (or firing) resistor. Ejection of an ink drop is achieved by passing an electric current through a selected firing resistor to superheat a thin layer of ink located within a selected firing chamber. This superheating causes an explosive vaporization of the thin layer of ink and an ink drop ejection through an associated nozzle of the printhead.

The resolution of an ink jet printer is directly related to the size and number of ink drops printed on a print medium. For example, for a given area a small number of large ink drops produces a relatively low-resolution printed image while a large number of small ink drops generally produces a higher-resolution printed image. The quality and resolution of printed images that a printer is capable of producing are often compared to photographs, and "photographic-quality" resolution means that the resolution approaches that of a photograph.

There is a continually increasing demand for low-cost ink jet printers that are capable of producing "photographic-quality" images. Achieving this high resolution while keeping costs low requires a careful balance between the architecture of the printhead (such as the architecture of the firing chamber, the firing resistor and the firing frequency) and the composition of liquid ink. Typically, a change in the printhead architecture or in the ink composition to solve one problem may create other problems. Thus, in order to produce an inexpensive ink jet printer capable of photographic-quality resolution, several factors in the printhead architecture and ink composition should be taken into account.

Additionally, six-color ink printing systems have been developed in which certain light-dye inks are used only for lower speed, higher quality printing, while other dark dye inks are used either solely for higher speed, lower quality printing or, when necessary, both higher and lower speed printing.

As the size of the individual ink drops is decreased, however, a number of difficulties arise. The sizes of the ink drops that are often used to produce high quality photographic images are often in a size range that can be adversely affected by nearby air disturbances. Standard inkjet printing systems include a plurality of rows of nozzles, with each row of nozzles coupled to a reservoir of ink of a different color. As the rows of nozzles are placed closer together, however, the motion of ink drops traveling through the air from the nozzles to the printing surface affects the direction of ink drops released from adjacent rows of nozzles, causing them to miss their intended target on the printing surface by some amount of error. Thus, the air disturbance caused by the ink drops results in a reduction of quality of the images being produced on the printing surface.

This problem is exacerbated as inkjet electronics and fluidic architectures are reduced in size in order to lower costs. As components such as smaller, lower-cost silicon chips are used, nozzle rows are positioned closer together and the amount of air disturbance that occurs between the rows of nozzles and the printing surface increases, further reducing the print quality.

There have been a number of potential solutions to the problem described above, but each has its own drawbacks. For example, reducing the printing speed can reduce the amount of air disturbance. The problem with such an approach, however, is that the amount of time for completing a print job is increased. An alternative approach has been to increase the number of multiple print passes in order to hide the defects caused by the aerodynamic disturbances. Increasing the number of multiple passes, however, also increases the amount of time for printing.

SUMMARY OF THE INVENTION

The present invention provides an effective system for reducing the problems associated with aerodynamic disturbances caused by ink drops as they are deposited on a printing surface.

The present invention comprises a multiple ink jet printing system including a plurality of rows of dark dye nozzles and light dye nozzles (also referred to as dark dye loads nozzles and light dye loads nozzles, respectively). Each row of dark dye nozzles is coupled to a supply of dark dye ink, and each row of light dye nozzles is coupled to a supply of light dye ink. Each of the rows of dark dye nozzles and light dye nozzles are arranged substantially parallel to each other, and at least one row of dark dye nozzles is separated from the next row of dark dye nozzles by at least one row of light dye nozzles.

The present invention also comprises a multiple ink jet printing system, which in some embodiments is a six ink jet printing system, a seven ink jet printing system, or an eight ink jet printing system. It includes a plurality of rows of dark dye nozzles coupled to supplies of ink of different colors, such as yellow, magenta, and cyan. It includes a plurality of rows of light dye nozzles are coupled to supplies of ink of different colors, such as yellow, black, magenta, and cyan. It includes one or more rows of black dye nozzles coupled to a supply of black ink. In some embodiments of the invention, these black dye nozzles are located at one end of the plurality of nozzle columns. Light yellow and/or light black nozzle columns are absent from some embodiments of the invention. Each of the rows of dark dye nozzles, light dye nozzles, and black dye nozzles are arranged substantially parallel to each other, and at least one row of dark dye nozzles is separated from the next row of dark dye nozzles by a row of light dye nozzles. In some embodiments, dark and light dye rows of nozzles alternate. In an alternative arrangement, the dark and light dye rows of nozzles alternate, but a yellow dark dye nozzle is positioned adjacent an adjoining dark dye nozzle of some other color, or a yellow dark dye nozzle is positioned adjacent the one or more rows of black dye nozzles.

The present invention also comprises a drop-on-demand printing system having a plurality of nozzle columns including a plurality of columns of dark dye nozzles, with each column of dark dye nozzles coupled to a source of dark dye ink. Each of a plurality of columns of light dye nozzles is coupled to a source of light dye ink, and a column of black dye nozzles is coupled to a source of black dye ink. The column of black dye nozzles is located at one end of the plurality of nozzle columns, and each of the columns of dark dye nozzles and light dye nozzles are arranged substantially parallel to each other. At least one column of dark dye nozzles is separated from the next column of dark dye nozzles by a column of light dye nozzles. This embodiment of the invention also includes the variations listed in the preceding paragraph.

DETAILED DESCRIPTION OF THE INVENTION

Figure 1:
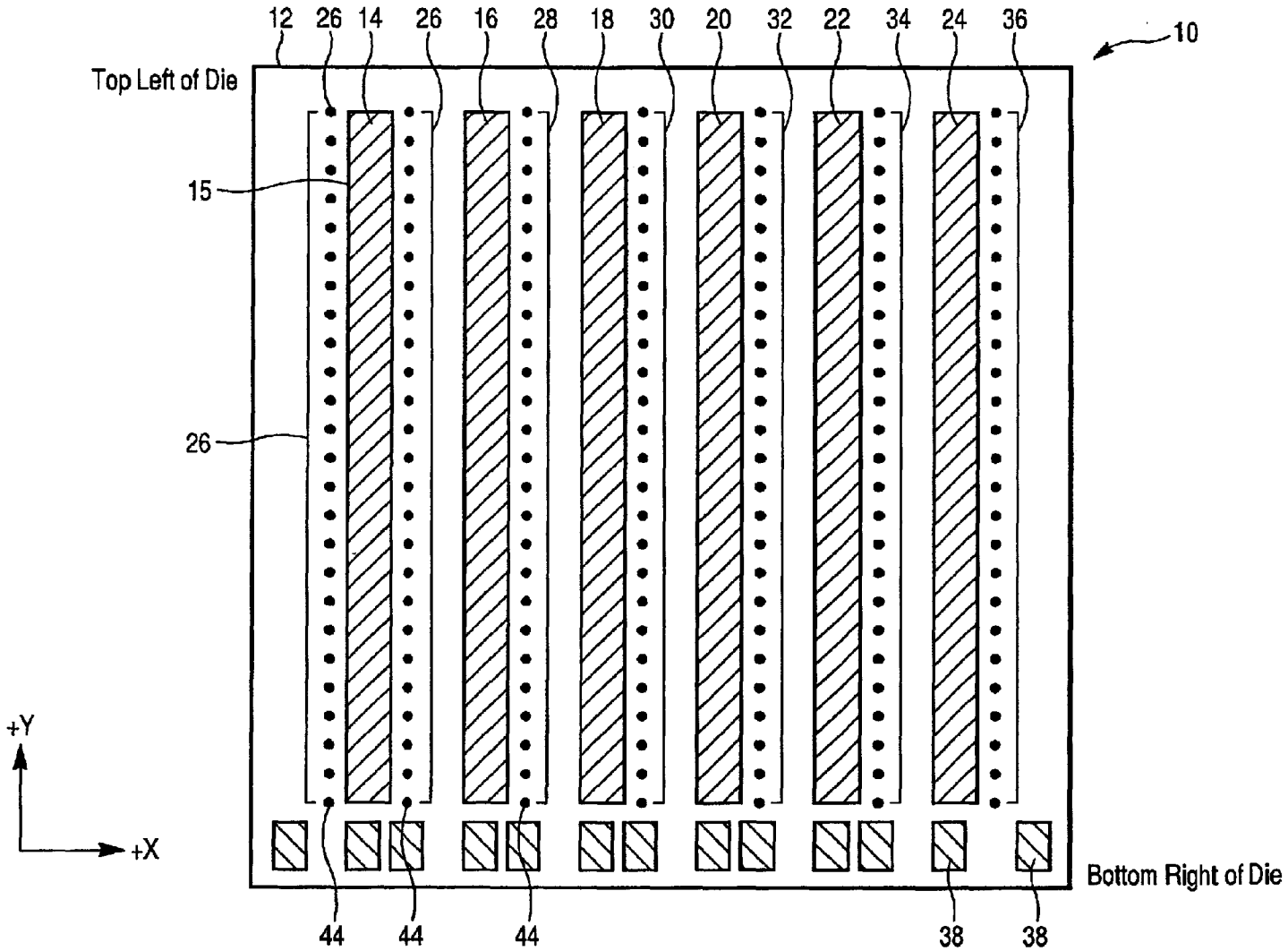
FIG. 1 is a side view of a die for a drop-on-demand printing system according to one embodiment of the invention.

FIG. 1 is a side view of one type of drop-on-demand, inkjet printing system 10 according to the present invention. The printing system 10 includes a die 12 which may comprise a first color ink slot 16, a second color ink slot 18, a third color ink slot 20, a fourth color ink slot 22, a fifth color ink slot 24 and a black ink slot 14. Each of the slots 14, 16, 18, 20, 22 and 24 may be rectangular in shape and may be etched into the die substrate from the back side of the die 12, which is made from silicon.

At least one black nozzle row 26 is located adjacent and operatively connected to the black ink slot 14. In one particular embodiment of the invention, there are two black nozzle rows 26 adjacent and operatively connected to the black ink slot 14. A first color ink nozzle row 28 is adjacent and operatively connected to the first color ink slot 16. A second color ink nozzle row 30 is adjacent and operatively connected to the second color ink slot 18. A third color ink nozzle row 32 is adjacent and operatively connected to the third color ink slot 20. A fourth color ink nozzle row 34 is adjacent and operatively connected to the fourth color ink slot 22. A fifth color ink nozzle row 36 is adjacent and operatively connected to the fifth color ink slot 24. The black ink nozzle rows 26 and the color ink nozzle rows 28, 30, 32, 34 and 36 each comprise a plurality of individual nozzles 44. The die 12 is generally bonded via glue or a similar method to a plastic pen body (not shown) that contains the ink. The die 12 also includes a plurality of bond pads 38. The bond pads 38 provide an electrical interconnect location for attaching the printhead chip circuitry to the rest of the electronics for the printing system. In one embodiment of the invention, this circuitry is connected using microscopic wire bonding techniques, although other techniques are also possible.

Each of the ink slots 14, 16, 18, 20, 22, and 24 are connected to their respective nozzles 44, in one embodiment of the invention, with a film of photosensitive polymer 15 that is exposed using a two stage photo-lithography process, with one photo defining the nozzles 44 and another photo exposure defining the ink slots 14, 16, 18, 20, 22 and 24. The ink slots 14, 16, 18, 20, 22 and 24, also referred to as channels, are formed directly on the die 12. The die 12 has holes etched into it using an etching process. The etching process produces several holes in the die to feed the ink slots 14, 16, 18, 20, 22 and 24 and the nozzles 44. These holes allow the ink to pass through the die 12 and reach the ink slots 14, 16, 18, 20, 22 and 24 that lead to the individual firing chambers. Ink flow is managed by balancing the backpressure, gravity flow, and surface tension so that the ink does not automatically flow out of the individual nozzles 44 while also permitting the firing chambers to refill after firing.

Figure 2:
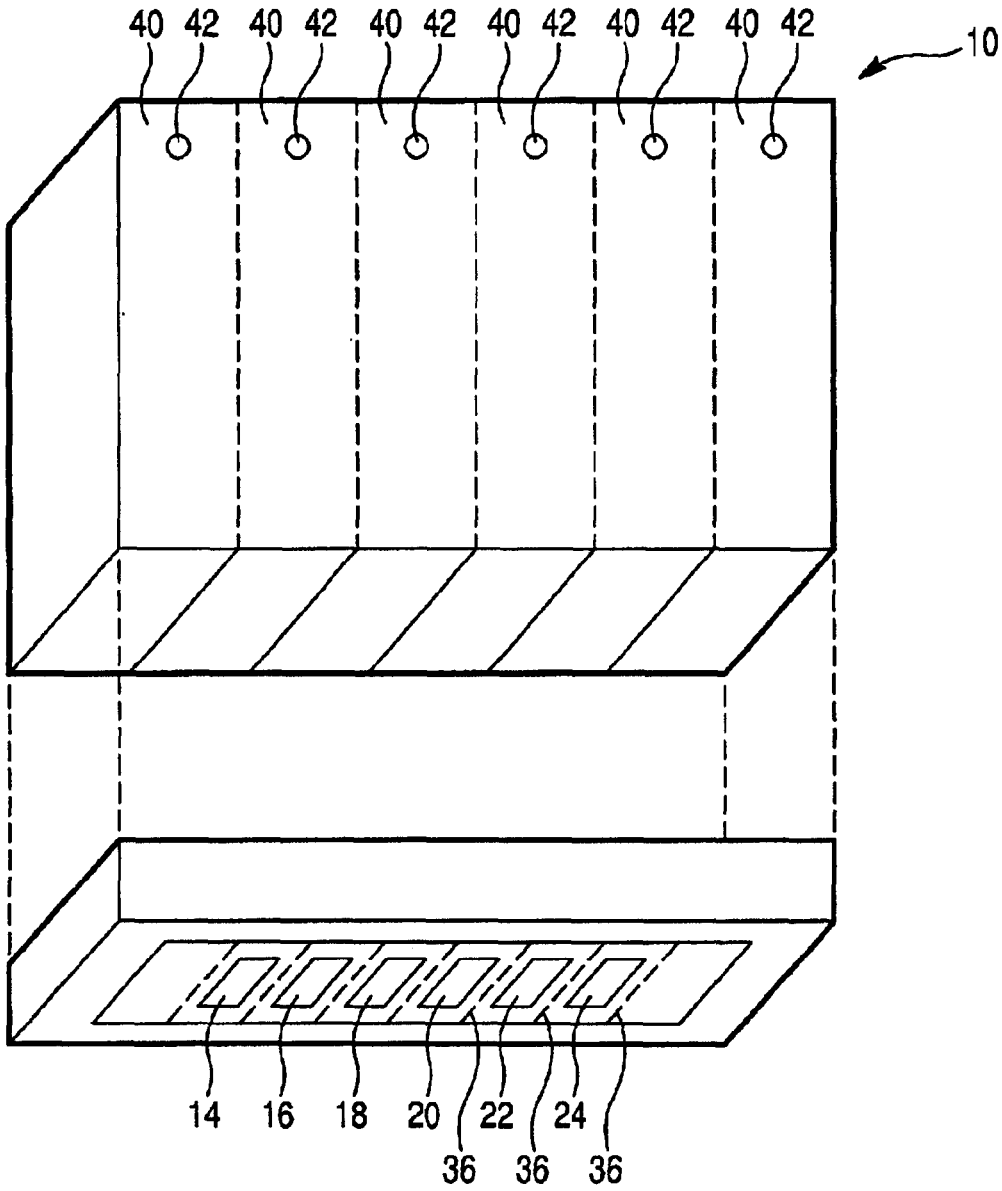
FIG. 2 is an exploded perspective view of the printing system of FIG. 1.

As shown in FIG. 2 and in one embodiment of the invention, a plurality of ink reservoirs 40 are located respectively above the black ink slot 14, the first color ink slot 16, second color ink slot 18, third color ink slot 20, fourth color ink slot 22, and fifth color ink slot 24. Each of the ink reservoirs 40 includes a quantity of ink of a different color. Each of the individual reservoirs 40 may also include a connector 42. The connectors 42 can be coupled to remote ink containers to permit a larger quantity of ink to be transferred to the paper or other printing surface.

In the ink jet printing system 10 described in FIGS. 1 and 2, the black ink nozzle row 26 and the first, second, third, fourth and fifth nozzle rows 28, 30, 32, 34 and 36 are arranged on the die 12 in a manner that reduces the amount of air disturbance between adjacent rows. In the inkjet six-ink printing system 10 of FIGS. 1 and 2, a combination of dark dye and light dye inks are used to improve the photographic image quality. The light dye inks are primarily useful in complementing the dark dye inks when printing high quality photographic images. These high quality images are printed at a low speed, often on special photo media. At these lower speeds imperfections resulting from air disturbance are typically not an issue. For higher speed printing, however, the severity of errors due to air disturbances are increased. High-speed printing is primarily performed on plain, non-specialty paper. Print quality on this type of paper typically does not benefit greatly from the use of light dye ink. Instead, dark dye ink only is more commonly used for such high-speed printing.

The present invention comprises placing one or more nozzle rows coupled to reservoirs with light dye inks between the nozzle rows that are coupled to dark dye inks. This placement permits an increased distance between the dark dye nozzle rows that are used during high-speed printing. This increased distance reduces the amount and severity of aerodynamic disturbances during printing. This arrangement also provides for more efficient use of the silicon area of the print head, and therefore increases the overall performance at a reduced cost.

In the embodiment of the invention shown in FIG. 1, the black ink slot 14 is placed at either end of the die 12, with one black ink nozzle row 26 positioned on each side of the black ink slot 14. In many printing systems, the black ink and the color inks are reactive with each other, so it is often preferable to keep at least one of the black ink nozzle rows 26 as far away from the first, second, third, fourth and fifth nozzle rows 28, 30, 32, 34 and 36 as possible. The placement of the black ink slot 14 at one end of the die 12 also allows for a smaller size die to be used when there are multiple black ink nozzle rows 26.

In the embodiment of FIG. 1, three dark dye inks and two light dye inks are used in the inkjet printing system 10. In this embodiment, the dark dye inks comprise the colors of yellow, dark magenta, and dark cyan, while the light dye colors comprise light magenta and light cyan. As discussed above, the black dye ink slot 14 is located at one end of the dye 12. This is followed by the first color ink slot 16 which is coupled to a supply of yellow ink. The second color ink slot 18 is coupled to a supply of light magenta ink. The third color ink slot 20 is coupled to a supply of dark magenta ink. The fourth color ink slot 22 is coupled to a supply of light cyan ink. The fifth color ink slot 24 is coupled to a supply of dark cyan ink.

In an alternate embodiment of the invention (also in accord with FIG. 1), black ink, three dark dye inks and two light dye inks are also used in the inkjet printing system 10. The dark dye inks again comprise the colors of yellow, dark magenta, and dark cyan, while the light dye colors comprise light magenta and light cyan. As in the previous embodiment, the black dye ink slot 14 is located at one end of the dye 12, and this is followed by the first color ink slot 16 which is coupled to a supply of yellow ink. Unlike the previously described embodiment, the second color ink slot 18 is coupled to a supply of light cyan ink. The third color ink slot 20 is coupled to a supply of dark cyan ink. The fourth color ink slot 22 is coupled to a supply of light magenta ink. The fifth color ink slot 24 is coupled to a supply of dark magenta ink. Thus, the positions of the cyan and magenta ink slots are reversed in this embodiment.

In both of the embodiments described above, the dark cyan and dark magenta inks are separated by light dye ink. Because dark cyan and light cyan are not often printed during the same print cycle simultaneously, these colors are placed next to each other to minimize the effect of aerodynamic-induced errors. Similarly, because light magenta and dark magenta are not often printed at the same time, these colors are also placed next to each other.

Although it is possible that the ink emanating from the black ink nozzle rows 26 could create aerodynamic-induced errors on the ink emanating from the first color ink nozzle row 28, having yellow ink emanate from the first color ink nozzle row 28 can help to minimize the effect of aerodynamic-induced errors. In the event that yellow ink is deflected due to aerodynamic effects, the mispositioned dots of yellow ink, due to yellow's relatively light color, are typically not as visible nor annoying as are misplaced dots from inks of other colors. Therefore, having the yellow ink transfer out of the first color ink nozzle row 28 closest to the black ink nozzle rows 26 tends to produce fewer visible errors due to aerodynamic effects, even if the black ink nozzle rows 26 transfer black ink at the same time as the adjacent color ink nozzle rows 28 and thereby cause aerodynamic disturbances. If one of the other colors were placed next to the black ink, on the other hand, it is possible that the flow of colored ink could interfere with the black ink.

In the above arrangement, the yellow dye ink is supplied to the slot 16 adjacent the black dye ink slot 14. As an alternative, the yellow dye ink may be supplied to the slot 24 at the far left edge of the die 12. For example, the ordering of the colors, from left to right as shown (or from right to left), could be: black, light magenta, dark magenta, light cyan, dark cyan, yellow; or it could be black, light cyan, dark cyan, light magenta, dark magenta, yellow.

In the embodiments of the invention illustrated by FIG. 1, there can be between about two hundred and about three hundred individual nozzles 44 in each of the nozzle rows 26, 28, 30, 32, 34 and 36. Each nozzle 44 is located about 1/600th of an inch from the next adjacent nozzle 44 of the same row. The distance between each of the first, second, third, fourth, and fifth color ink nozzle rows 28, 30, 32, 34, 36 is typically between about 1300 micrometers and about 2000 micrometers. The distance between the two black ink nozzle rows 26 is typically significantly smaller. In a typical application, this distance is approximately 170 micrometers. (The drawings are not done to scale.) During printing, the distance from each individual nozzle 44 to the paper is typically about fifty mils, or about 1.27 millimeters.

Figure 3:
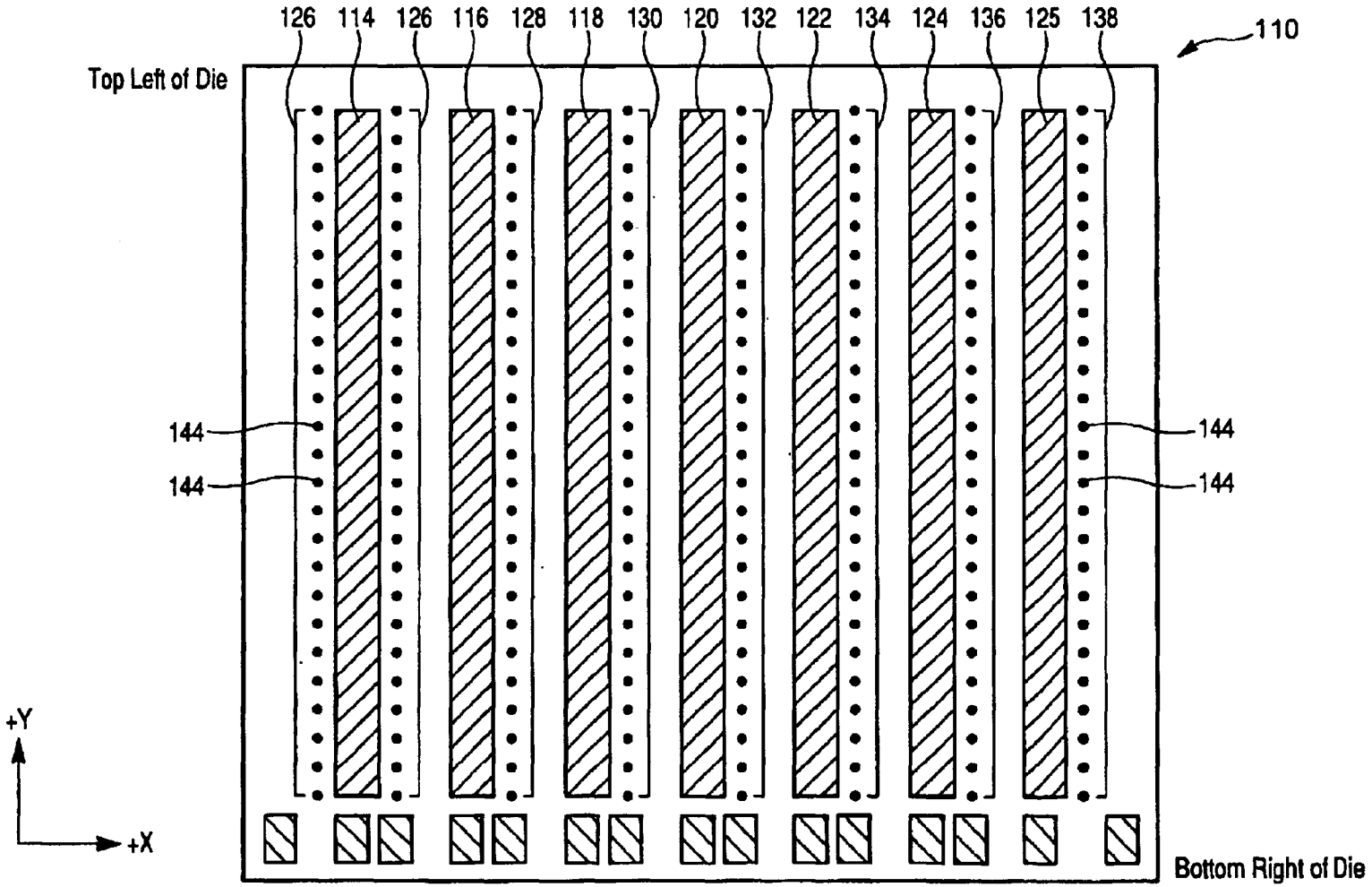
FIG. 3 is a side view of a die for a drop-on-demand printing system according to an alternate embodiment of the invention.

In an alternate embodiment of the invention and as shown in FIG. 3, three colors of dark dye ink and three colors of light dye ink are used. In this arrangement, a drop-on-demand, seven-ink inkjet printing system 110 includes a black ink slot 114 followed by first, second and third, fourth, fifth, and sixth color ink slots 116, 118, 120, 122, 124, and 125. Instead of having a single yellow ink slot, both a light yellow ink slot and a dark yellow ink slot are provided.

As in the previous embodiments, one or two black ink nozzle rows 126 are adjacent and operatively connected to the black ink color slot 114. A first color ink nozzle row 128 is adjacent and operatively connected to the first color ink slot 116; a second color ink nozzle row 130 is adjacent and operatively connected to the second color ink slot 118; a third color ink nozzle row 132 is adjacent and operatively connected to the third color ink slot 120; a fourth color ink nozzle row 134 is adjacent and operatively connected to the fourth color ink slot 122; a fifth color ink nozzle row 136 is adjacent and operatively connected to the fifth color ink slot 124; and a sixth color ink nozzle row 138 is adjacent and operatively connected to the sixth ink slot 125. The black ink nozzle rows 126 and the first, second, third, fourth, fifth and sixth color ink nozzle rows 128, 130, 132, 134, 136 and 138 each comprise a plurality of individual nozzles 144. A light dye ink is placed in the first color ink slot 116 adjacent to the black in slot 114, and the remaining slots alternate between dark dye inks and light dye inks. In one particular embodiment, the order of the colors is black, light yellow, dark yellow, light cyan, dark cyan, light magenta, dark magenta. The slots assigned to cyan and magenta colors can be reversed.

Alternatively, the slot 114 may contain dark black dye, the slot 116 may contain light black dye, and only a single slot of yellow would be provided. For example, yellow could be assigned to the slot 125, and then the assignment of colors to slots could be dark black 114, light black 116, dark magenta 118, light magenta 120, dark cyan 122, light cyan 124, yellow 125. Alternatively, the assignment of colors to slots can be, with yellow assigned to the central slot 122, as follows: dark black 114, light black 116, dark magenta 118, light magenta 120, yellow 122, light cyan 124, and dark cyan 125. And, of course, the cyan and magenta slot assignments can be reversed. Other similar combinations are also possible.

Figure 4:
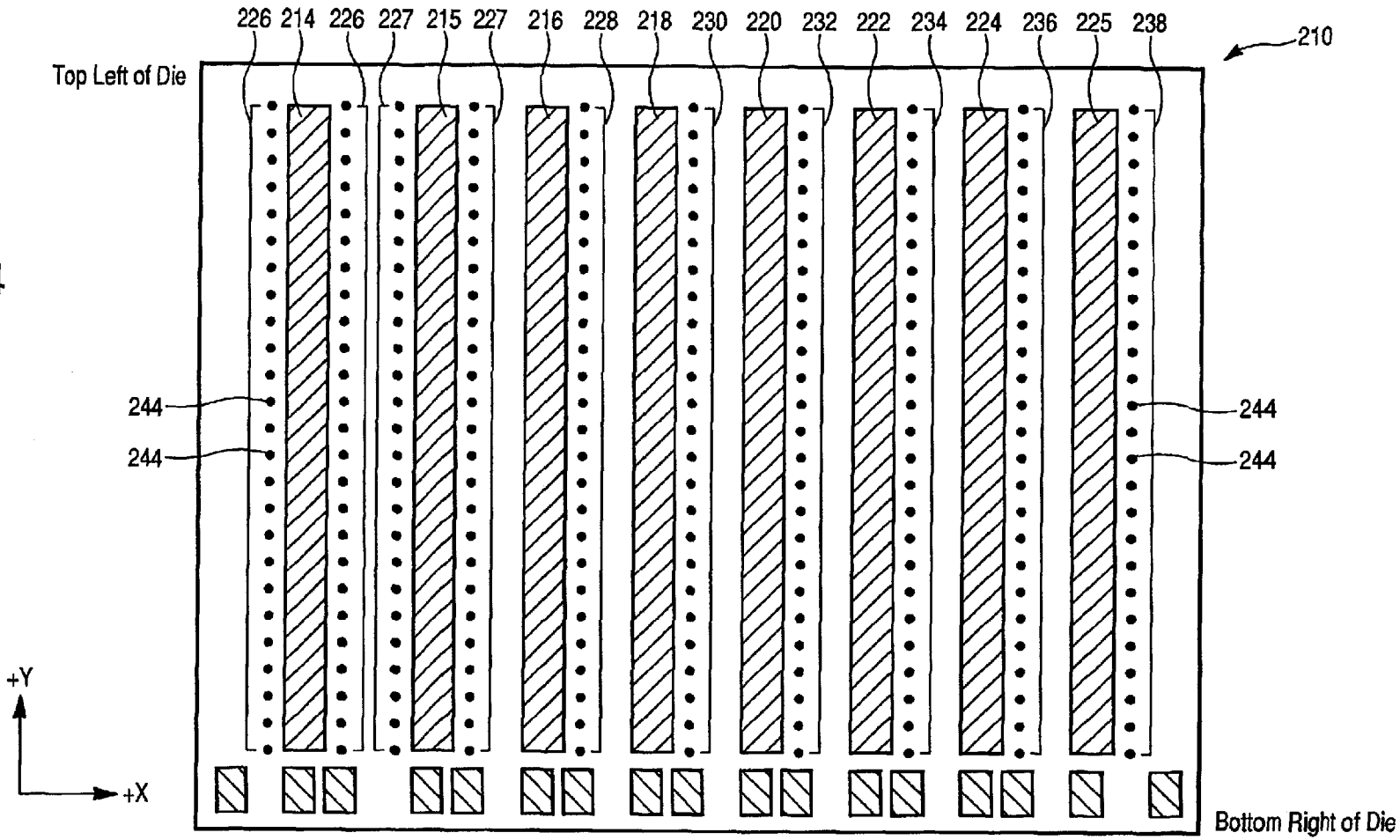
FIG. 4 is a side view of a die for a drop-on-demand printing system according to a third embodiment of the invention.

FIG. 4 shows yet another embodiment of the invention in which three colors of dark dye ink, three colors of light dye ink, a light dye black ink, and a dark dye black ink are used. In this arrangement, the light dye black ink is used primarily for light dye, low speed printing, while the dark dye black ink is used primarily for dark dye, high speed printing. In this arrangement a drop-on-demand, eight-ink inkjet printing system 210 includes a dark black ink slot 214, a light black ink slot 215, first, second and third, fourth, fifth, and sixth color ink slots 216, 218, 220, 222, 224, and 225.

One or two dark black ink nozzle rows 226 are located adjacent and operatively connected to the dark black ink color slot 214. Similarly, one or two (most likely just one) light black ink nozzle rows 227 are adjacent and operatively connected to the light black ink color slot 215. First, second, third, fourth, fifth, and sixth color ink nozzle rows 228, 230, 232, 234, 236, and 238 are respectively adjacent and operatively connected to first, second, third, fourth, fifth, and sixth color ink slots 216, 218, 220, 222, 224, and 225. The black ink nozzle rows 226 and 227 and the color ink nozzle rows 228, 230, 232, 234, 236 and 238 each comprise a plurality of individual nozzles 244. The dark black ink is placed in the dark black slot 215 adjacent to the light black ink slot 214, and the remaining slots alternate between light dye inks and dark dye inks. In one particular embodiment, the order of the colors is dark black, light black, dark yellow, light yellow, dark cyan, light cyan, dark magenta, light magenta. An alternative order is dark black, light black, dark yellow, light yellow, dark magenta, light magenta, dark cyan, light cyan. The order of dark and light slot assignments may be reversed. Other combinations are also possible depending upon the particular design and performance requirements.

While the preferred embodiment of the invention as implemented in a prototype system has been described, it will be understood by those skilled in the art to which the invention pertains that numerous modifications and changes may be made without departing from the true spirit and scope of the invention. For example, the exact number of individual nozzles, the spacing between nozzles, the spacing between nozzle rows, and the distance from the end of the nozzles to the paper can all be varied depending upon the particular manufacturing and performance requirements. The exact order and number of black dye inks, light dye inks, and dark dye inks can also vary depending upon the particular performance and manufacturing requirements of the printing system and the chemical properties of the ink. It is also possible that inks of colors other than those described herein could be used in an inkjet printing system according to the present invention. A variety of systems for supplying ink to the individual nozzles can also be used. This application is accordingly intended to define the scope of the invention precisely in the claims appended to and forming a part of this application.

What is claimed is:

1. A multiple ink jet printing system having a plurality of substantially parallel rows of dye nozzles, comprising:

a plurality of rows of dark dye nozzles, each row of dark dye nozzles coupled to a supply of dark dye ink;

a plurality of rows of light dye nozzles, each row of light dye nozzles coupled to a supply of light dye ink;

wherein each of the rows of dark dye nozzles and light dye nozzles are arranged substantially parallel to each other, and wherein at least one row of dark dye nozzles is separated from the next row of dark dye nozzles by a row of light dye nozzles; and wherein a combination of light dye ink and dark dye ink is used during low speed printing and only dark dye ink is used during high speed printing, and wherein at least one of said dark dye nozzles is adapted for color printing.

2. The printing system of claim 1, comprising at least four rows of dark dye nozzles, wherein each row of dark dye nozzles is coupled to a supply of dark dye ink of a different color, the supplies of dark dye ink including the colors of black, cyan, magenta, and yellow.

3. The printing system of claim 2, comprising at least two rows of light dye nozzles, wherein each row of light dye nozzles is coupled to a supply of light dye ink of a different color, the supplies of light dye ink, including the colors of light cyan and light magenta.

4. The printing system of claim 2, comprising at least three rows of light dye nozzles, wherein each row of light dye nozzles is coupled to a supply of light dye ink of a different color, the supplies of light dye ink including the colors of light cyan, light magenta, and light yellow.

5. The printing system of claim 2, comprising at least three rows of light dye nozzles, wherein each row of light dye nozzles is coupled to a supply of light dye ink of a different color, the supplies of light dye ink including the colors of light cyan, light magenta, and light black.

6. The printing system of claim 2, comprising at least four rows of light dye nozzles, wherein each row of light dye nozzles is coupled to a supply of light dye ink of a different color, the supplies of light dye ink including the colors of light cyan, light magenta, light yellow and light black.

7. The printing system of claim 1, wherein the rows of dark dye nozzles are separated from each other by rows of light dye nozzles.

8. The printing system of claim 1, wherein the rows of dark dye nozzles with the exception of any row of yellow dark dye nozzles are separated from each other by rows of light dye nozzles and yellow dye nozzles.

9. The printing system of claim 8, wherein the at least one row of dye nozzles coupled to a supply of black ink is coupled to a supply of dark black ink and is followed by a row of dye nozzles coupled to a supply of light black ink, wherein only one row of dye nozzles is coupled to a supply of yellow ink, and wherein dark and light ink rows alternate, with the row of dye nozzles coupled to a supply of yellow ink being treated as a dark ink row in this alternation pattern.

10. The printing system of claim 1, wherein at least one row of dye nozzles is coupled to a supply of black ink and is located at one end of the plurality of rows of dye nozzles.

11. The printing system of claim 10, wherein the at least one row of dye nozzles coupled to a supply of black ink is followed by a row of yellow dye nozzles which is followed by rows of the remaining nozzles arranged in alternating rows of light and dark dye nozzles, with a row of light dye nozzles adjacent the row of yellow dye nozzles.

12. The printing system of claim 10, wherein a row of yellow die nozzles is located at the other end of the plurality of rows of dye nozzles, and wherein the remaining rows of dye nozzles are arranged between the black and yellow nozzles rows of dye nozzles in alternating rows of light and dark dye nozzles starting with a row of light dye nozzles adjacent the at least one row of dye nozzles coupled to a supply of black ink.

13. A six ink jet printing system, comprising:

a plurality of rows of dark dye nozzles, each row of dark dye nozzles coupled to a supply of ink and having a color selected from the group consisting of cyan and magenta;

a row of yellow dye nozzles;

one or more rows of adjacent black dye nozzles coupled to a supply of black ink; and a plurality of rows of light dye nozzles, each row of light dye nozzles coupled to a supply of ink and having a color selected from cyan, magenta, yellow, and black;

wherein each of the rows of the yellow dye nozzles, dark dye nozzles, light dye nozzles, and black dye nozzles are arranged substantially parallel to each other, and wherein each row of nozzles adjacent to a row of dark dye nozzles and the one or more rows of black dye nozzles is a row of light dye nozzles or the row of yellow dye nozzles; and wherein the ink used during high-speed printing is stored in the supplies coupled to the dark dye nozzles and yellow dye nozzles.

14. The system of claim 13, wherein a first row of light dye nozzles, is coupled to a supply of ink having a light cyan color, and a second row of light dye nozzles, is coupled to a supply of ink having a light magenta color.

15. The system of claim 13, wherein the row of yellow dye nozzles is arranged at a position directly between one row of light dye nozzles and the one or more rows of adjacent black dye nozzles.

16. The system of claim 13, wherein one row of light dye nozzles is arranged at a position directly between one row of dark dye nozzles and the one or more rows of black dye nozzles.

17. The system of claim 13, wherein the ink used during low speed printing is stored in the supplies coupled to the light and dark dye nozzles and yellow dye nozzles, and wherein the light dye nozzles are not used during high speed printing.

18. A seven ink jet printing system, comprising:

a plurality of rows of dark dye nozzles, each row of dark dye nozzles coupled to a supply of ink and having a color selected from the group consisting of cyan and magenta;

a row of yellow dye nozzles;

one or more rows of adjacent black dye nozzles coupled to a supply of black ink; and a plurality of rows of light dye nozzles, each row of light dye nozzles coupled to a supply of ink and having a color selected from cyan, magenta, yellow, and black;

wherein each of the rows of the yellow dye nozzle, dark dye nozzles, light dye nozzles, and black dye nozzles are arranged substantially parallel to each other, and wherein each row of nozzles adjacent to a row of dark dye nozzles or the one or more rows of black dye nozzles is a row of light dye nozzles; and wherein the ink used during high-speed printing is stored in the supplies coupled to the dark dye nozzles and yellow dye nozzles.

19. The system of claim 18, wherein a first row of light dye nozzles is coupled to a supply of ink having a light cyan color, a second row of light dye nozzles is coupled to a supply of ink having a light magenta color, and a third row of light dye nozzles is coupled to a supply of ink having a light yellow color.

20. The system of claim 18, wherein a first row of light dye nozzles is coupled to a supply of ink having a light cyan color, a second row of light dye nozzles is coupled to a supply of ink having a light magenta color, and a third row of light dye nozzles is coupled to a supply of ink having a light black color.

21. The system of claim 18, wherein one row of light dye nozzles is arranged at a position directly between one row of dark dye nozzles and the one or more rows of black dye nozzles.

22. The system of claim 18, wherein the ink used during low speed printing is stored in the supplies coupled to the light and dark dye nozzles and yellow dye nozzles, and wherein the light dye nozzles are not used during high speed printing.

23. An eight ink jet printing system, comprising:

a plurality of rows of dark dye nozzles, each row of dark dye nozzles coupled to a supply of ink and having a color selected from the group consisting of cyan, magenta, and yellow;

one or more rows of adjacent dark black dye nozzles coupled to a supply of black ink; and a plurality of rows of light dye nozzles, each row of light dye nozzles coupled to a supply of ink and having a color selected from cyan, magenta, yellow, and black;

wherein each of the rows of the dark dye nozzles, light dye nozzles, and dark black dye nozzles are arranged substantially parallel to each other, and wherein each row of nozzles adjacent to a row of dark dye nozzles is a row of light dye nozzles; and wherein the ink used during high-speed printing is stored in the supplies coupled to the dark dye nozzles.

24. The system of claim 23, wherein the ink used during low speed printing is stored in the supplies coupled to the light and dark dye nozzles and yellow dye nozzles, and wherein the light dye nozzles are not used during high speed printing.

25. A drop-on-demand printing system having a plurality of nozzle columns, comprising:

a plurality of columns of dark dye nozzles, each column of dark dye nozzles coupled to a source of dark dye ink;

a plurality of columns of light dye nozzles, each columns of light dye nozzles coupled to a source of light dye ink; and one or more columns of adjacent dark black dye nozzles coupled to a source of black dye ink, the columns of black dye nozzles located at one end of the plurality of nozzle columns, wherein each of the columns of dark dye nozzles and light dye nozzles are arranged substantially parallel to each other, and wherein at least one column of dark dye nozzles is separated from the next row of dark dye nozzles by a row of light dye nozzles; and wherein the ink used during high-speed printing is stored in the supplies coupled to the dark dye nozzles.

26. The system of claim 25, comprising at least three columns of dark dye nozzles, wherein each column of dark dye nozzles is coupled to a source of dark dye ink of a different color, the supplies of dark dye ink including the colors of cyan, magenta, and yellow.

27. The system of claim 25, comprising at least two columns of light dye nozzles, wherein each column of light dye nozzles is coupled to a source of light dye ink of a different color, the supplies of light dye ink including the colors of light cyan and light magenta.

28. The system of claim 27, wherein each column of dark dye nozzles is separated from the next column of dark dye nozzles by a column of light dye nozzles.

29. The system of claim 28, wherein one column of light dye nozzles is located directly between one column of dark dye nozzles and the one or more columns of dark black dye nozzles.

30. The system of claim 29, wherein one column of yellow nozzles is located at the other end of the plurality of nozzle columns adjacent a column containing dark dye nozzles.

31. The system of claim 28, wherein one column of dark yellow nozzles is located directly between one column of light dye nozzles and the one or more column of dark black dye nozzles.

32. The system of claim 25, wherein the ink used during low speed printing is stored in the supplies coupled to the light and dark dye nozzles and yellow dye nozzles, and wherein the light dye nozzles are not used during high speed printing.

33. A multiple ink jet printing system having a plurality of substantially parallel rows of dye nozzles, comprising:

a plurality of rows of dark dye nozzles, each row of dark dye nozzles coupled to a supply of dark dye ink;

a plurality of rows of light dye nozzles, each row of light dye nozzles coupled to a supply of light dye ink;

wherein each of the rows of dark dye nozzles and light dye nozzles are arranged substantially parallel to each other; and wherein a combination of light dye ink and dark dye ink is used during low speed printing and only dark dye ink is used during high speed printingAfld wherein at least one of said dark dye nozzles is adapted for color printing.

34. An ink jet printing system, comprising:

a plurality of rows of dark dye nozzles, each row of dark dye nozzles coupled to a supply of ink and having a color selected from the group consisting of cyan and magenta;

a row of yellow dye nozzles;

one or more rows of adjacent black dye nozzles coupled to a supply of black ink; and a plurality of rows of light dye nozzles, each row of light dye nozzles coupled to a supply of ink and having a color selected from cyan, magenta, yellow, and black;

wherein each of the rows of the yellow dye nozzles, dark dye nozzles, light dye nozzles, and black dye nozzles are arranged substantially parallel to each other; and wherein the ink used during high-speed printing is stored in the supplies coupled to the dark dye nozzles and yellow dye nozzles.

35. The system of claim 34, wherein the ink used during low speed printing is stored in the supplies coupled to the light and dark dye nozzles and yellow dye nozzles, and wherein the light dye nozzles are not used during high speed printing.

* * * * *

UNITED STATES PATENT AND TRADEMARK OFFICE

CERTIFICATE OF CORRECTION

PATENT NO. : 6,812,953 B2
DATED : November 2, 2004
INVENTOR(S) : Peterson et al.

It is certified that error appears in the above-identified patent and that said Letters Patent is hereby corrected as shown below:

Column 10,
Line 60, delete “printingAfld” and insert therefor -- printing and --.

Signed and Sealed this

Fifth Day of July, 2005

JON W. DUDAS
*Director of the United States Patent and Trademark Office*